US009521938B2

(12) United States Patent
Eisenhut

(10) Patent No.: US 9,521,938 B2
(45) Date of Patent: Dec. 20, 2016

(54) CLEANING DEVICE WITH PRODUCT INFORMATION

(71) Applicant: Carl Freudenberg KG, Weinheim (DE)

(72) Inventor: Andreas Eisenhut, Leimen (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 14/350,291

(22) PCT Filed: Sep. 26, 2012

(86) PCT No.: PCT/EP2012/004030

§ 371 (c)(1),
(2) Date: Apr. 7, 2014

(87) PCT Pub. No.: WO2013/053434

PCT Pub. Date: Apr. 18, 2013

(65) Prior Publication Data

US 2014/0215742 A1 Aug. 7, 2014

(30) Foreign Application Priority Data

Oct. 10, 2011 (DE) ..... 10 2011 115 372

(51) Int. Cl.

| | |
|---|---|
| ***A47L 13/20*** | (2006.01) |
| ***A47L 13/16*** | (2006.01) |
| ***G09F 23/00*** | (2006.01) |
| ***A47L 13/42*** | (2006.01) |

(52) U.S. Cl.
CPC ..... *A47L 13/16* (2013.01); *A47L 13/20* (2013.01); *A47L 13/42* (2013.01); *G09F 23/00* (2013.01)

(58) Field of Classification Search
CPC ..... A47L 13/20; A47L 13/16; A47L 13/44
See application file for complete search history.

(56) References Cited

U.S. PATENT DOCUMENTS

| | | | | |
|---|---|---|---|---|
| 2,843,868 | A | 7/1958 | Borgstrom | |
| 3,938,570 | A * | 2/1976 | Stewart | 150/160 |
| 5,709,005 | A * | 1/1998 | Brach et al. | 15/145 |
| 5,887,311 | A * | 3/1999 | Kresse | D04D 9/00 15/228 |

(Continued)

FOREIGN PATENT DOCUMENTS

| | | | |
|---|---|---|---|
| CN | 1416386 | A | 5/2003 |
| CN | 1575145 | A | 2/2005 |

(Continued)

*Primary Examiner* — Shin Kim
(74) *Attorney, Agent, or Firm* — Fraser Clemens Martin & Miller LLC; James D. Miller

(57) ABSTRACT

The invention relates to a cleaning device (1', 1", 1'") comprising a component (2', 2", 2'") which has associated product information (3). The aim of the invention is to develop and further improve a cleaning device of said type, such that once it has been easily marked with product information, said product permanently carries said product information. The device is characterized in that said component (2', 2", 2'") comprises a surface (2'*a*, 2"*a*, 2'"*a*) in which the product information (3) is intrinsic and/or integral with the material, said product information (3) having been formed by means which are interspaced from said surface (2'*a*, 2"*a*, 2'"*a*).

20 Claims, 2 Drawing Sheets

(56) References Cited

U.S. PATENT DOCUMENTS

| | | | | |
|---|---|---|---|---|
| D445,227 | S * | 7/2001 | Tintelnot | D32/40 |
| 6,777,064 | B1 * | 8/2004 | Brown | A47L 13/16 15/208 |
| 7,174,600 | B2 * | 2/2007 | Kresse et al. | 15/260 |
| 7,487,567 | B2 * | 2/2009 | Kresse | A47L 13/20 15/228 |
| 8,220,103 | B1 * | 7/2012 | Lewis | A47L 13/20 15/118 |
| D747,581 | S * | 1/2016 | Yamada | D32/40 |
| 2003/0124935 | A1 | 7/2003 | Smith et al. | |
| 2005/0018030 | A1 | 1/2005 | Brasier et al. | |
| 2005/0120497 | A1 * | 6/2005 | Lynde et al. | 15/104.94 |
| 2006/0003912 | A1 | 1/2006 | Lindsay et al. | |
| 2007/0020440 | A1 * | 1/2007 | Wong et al. | 428/178 |
| 2007/0256267 | A1 * | 11/2007 | Burnett | 15/229.1 |
| 2009/0144926 | A1 * | 6/2009 | Fava | 15/228 |
| 2009/0286039 | A1 * | 11/2009 | Weedlun et al. | 428/114 |
| 2011/0226638 | A1 * | 9/2011 | Hoadley et al. | 206/229 |
| 2011/0247158 | A1 * | 10/2011 | Jungnickel et al. | 15/167.1 |

FOREIGN PATENT DOCUMENTS

| | | | |
|---|---|---|---|
| CN | 101001561 | A | 7/2007 |
| DE | 3630769 | A1 | 3/1988 |
| DE | 10010508 | A1 | 9/2001 |
| DE | 202006018231 | U1 | 2/2007 |
| DE | 102006005984 | A1 | 8/2007 |
| EP | 1405591 | A1 | 4/2004 |
| EP | 1961359 | A1 * | 8/2008 |
| JP | 2003135351 | A | 5/2003 |
| JP | 2003525779 | A | 9/2003 |
| JP | 3106449 | | 10/2004 |
| JP | 2007160122 | A | 6/2007 |
| JP | 20099256839 | A | 11/2009 |
| JP | 2011092370 | A | 5/2011 |
| WO | 2005027706 | A1 | 3/2005 |
| WO | 2007090570 | | 8/2007 |

* cited by examiner

CLEANING DEVICE WITH PRODUCT INFORMATION

CROSS-REFERENCE TO RELATED APPLICATIONS

This application is a United States national phase application based on PCT/EP2012/004030 filed Sep. 26, 2012 which claims the benefit of German Application Serial No. 10 2011 115 372.5 filed Oct. 10, 2011. The entire disclosure of the above application is hereby incorporated herein by reference.

TECHNICAL AREA

This invention relates to a cleaning device referred to in the preamble of Patent Claim 1.

BACKGROUND OF THE INVENTION

There are cleaning devices presently known, specifically floor mop coverings, to which a unit (typically textile) is attached. Such units are commonly designated as "labels" and are furnished with product information.

This product information contains manufacturing specifications, washing instructions, product numbers, or batch numbers, in addition to other information.

Presently, these units or "labels" are affixed to these cleaning devices as separate components. These units can, for example, be sewn or glued on to a band on the floor mop covering.

It is disadvantageous that these units or "labels" must be treated as separate components and must be applied either by hand or by a semi-automated process.

Moreover, it can be difficult and expensive to furnish a cleaning device with certain information, such as consecutive product numbers, since the units typically need to be pre-fabricated in large batches.

Finally, a unit or "label" of this type can be damaged or detached by the use of the cleaning device.

SUMMARY OF THE INVENTION

The purpose of this invention is to design and develop a cleaning device of the type previously named, which can be easily and permanently marked with product information.

This invention achieves this by use of the features described in Patent Claim 1.

The cleaning device, according to the present invention, includes a component upon which the product information is attached.

The cleaning device according to the present invention is designed so that this component features a surface on which the product information is intrinsic and/or integral to the material, having been formed by an instrument that is remote from said surface.

According to the present invention, the previously indicated units or labels could be eliminated. The product information could be directly and immediately applied to a component of the cleaning device without these labels. The inscription or identification mark with product information could be applied simultaneously during the manufacturing of the component. In particular, the inscription or identification mark with product information could occur simultaneously with the cutting process. According to the present invention, there is no need for separate components to serve as labels. Furthermore, even small lot sizes of cleaning devices could easily be marked with consecutive product numbers or manufacturer logos. It is even possible that each cleaning device could be a unique, individually identified item. Finally, the product information is attached permanently to the cleaning device after laundering of the device or during use, and cannot detach itself the way a separate component can. In this respect, the cleaning device described can be easily marked with product information and thereafter permanently displays said information.

Consequently, the invention achieves the previously stated purpose.

A laser could be used as the marking agent. The use of a laser, by utilizing the wavelength of the laser beam, allows adjustment of the contrast of the product information relative to the surrounding areas which have not been treated by the laser. Areas of a dark surface can be lightened by means of a laser beam. It is also possible, however, to darken areas of a light surface by means of laser beam. By means of appropriate laser beams, the color of the surface can also be altered.

The components could also be marked by means of an ink-jet using an acid. Specifically, a jet printer could, at a distance, mark product information upon a surface.

The marking agent could be used to texturally alter areas of the surface, with the textural alterations designed as characters, numbers, or symbols which depict the product information. Thus the product information could directly become intrinsic to the component without the use of additional materials.

The characters or symbols depicting the product information could protrude downward less than 0.1 mm from the surface. By this, the texture of the surface will be altered minimally by the product information.

The surface could feature, or consist of a synthetic material. A laser can heat a surface of polyester or polypropylene in such a manner that the heated areas foam. The laser creates a microstructure of foam which withdraws visually from the unheated surface and in turn develops a contrast or color difference from the unheated areas. In this manner a laser beam could inscribe lettering, numbers, or picture elements directly onto a component.

This component could be a finger loop, to which product information can advantageously be applied without being located on a cleaning surface. "Cleaning surface" is understood as a surface which faces an object to be cleaned.

The cleaning device describe here could be a floor mop covering. Floor mop coverings are very commonly placed beneath cleaning devices and must therefore firmly adhere to prevent a loss of product information.

The cleaning device described here could be a sponge, specifically a wiping sponge. Very soft and compressible sponges, which are difficult to mechanically imprint, could be advantageously remotely inscribed.

The cleaning device described here could be a cloth, specifically a dust cloth. Cloths can be continuously produced in sheets and can therefore easily be remotely inscribed.

The product information could be applied to all textile components of the cleaning device, even in their interior. Preferably, however, the product information would not be applied to a cleaning surface of the cleaning device. "Cleaning surface" is to be understood as a surface which faces an object to be cleaned.

There are now various possibilities to advantageously implement the design and further the development of the present invention. Refer to the following subordinate patent claims and the following explanation of preferred examples of the cleaning device according to the present invention with the help of the drawings.

In connection with the explanation of the preferred embodiments of the invention, the drawing will also help to implement the preferred general design and further development of the invention.

EMBODIMENTS OF THE INVENTION

Figure 1:
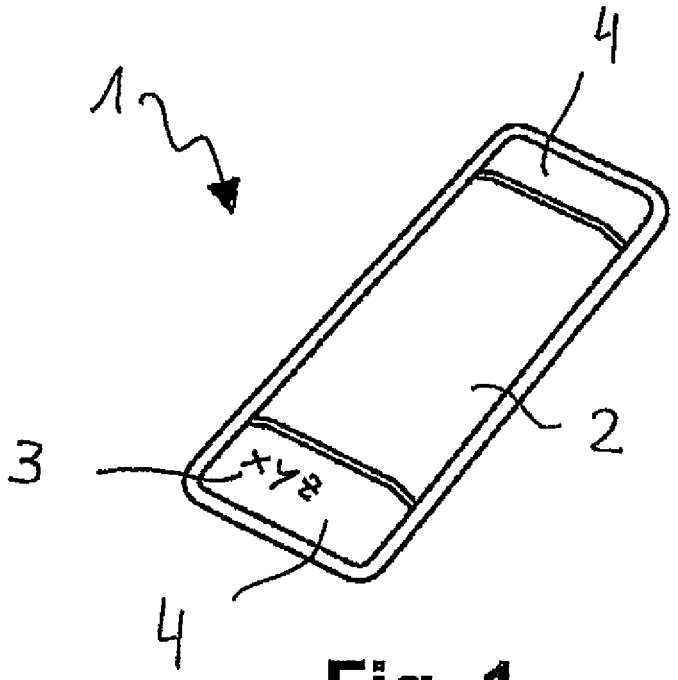
FIG. 1: a perspective view of a floor mop covering, which displays on its longitudinal ends two slots, in which one slot is first printed and then sewn onto the unit.

FIG. 1 shows a cleaning device (1) of this type, incorporating a component (2) with associated product information (3). The cleaning device (1) shown is a floor mop covering.

On the component (2) are two slots (4) in which a receptacle or mop wing can be inserted. It is concretely represented that a slot is formed on each longitudinal end of the component (2).

A slot (4) has been printed with the product information as a separate component which has then been sewn on the component (2) as a "label."

Figure 2:
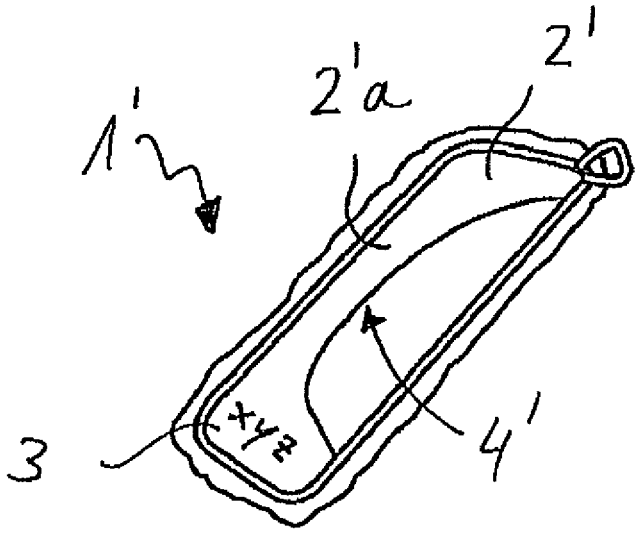
FIG. 2: a perspective view of an additional floor mop covering with a slot extending the length of the whole component.

FIG. 2 shows a cleaning device (1') including a component (2') with associated product information (2). The component (2') has a surface (2'*a*) in which the product information (3) is intrinsic and/or integral to the material, with the product information (3) having been formed by means of an agent that is remotely located from said surface (2'*a*).

The marking agent is a laser. The surface (2'*a*) is texturally altered in some areas, with the textural alterations forming characters, numbers, or symbols, shown here as the letters x, y, and z, which depict the product information (3).

The characters, numbers, or symbols depicting the product information protrude downward less than 0.1 mm from the surface (2'*a*). The surface (2'*a*) consists of a synthetic material, preferably polyester or polypropylene.

The cleaning device is a floor mop covering. FIG. 2 concretely represents a floor mop covering which features an oblong component (2') with a slot (4') extending nearly the entire length of the component (2'). The slot (4') is curved and functions as a type of sheath.

Figure 3:
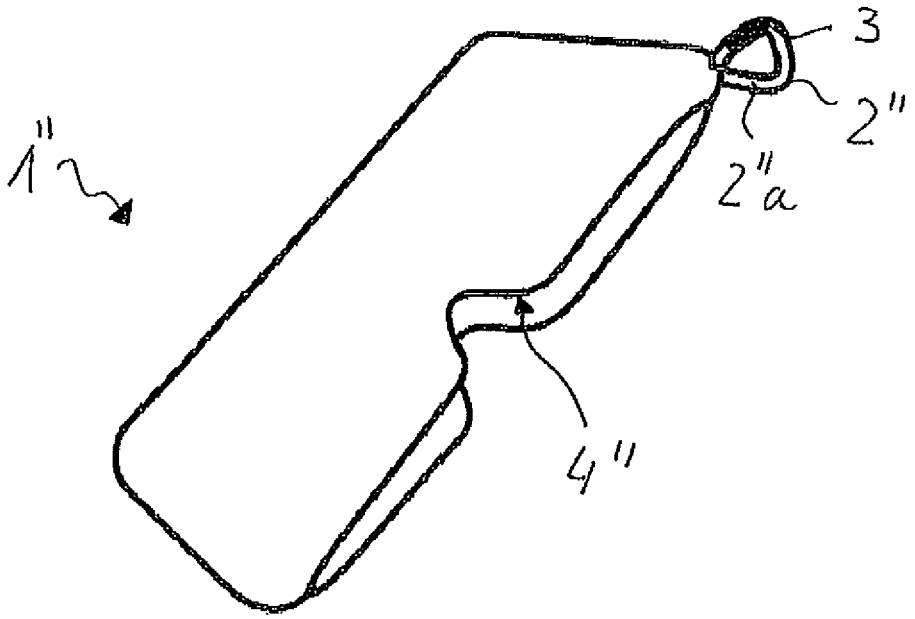
FIG. 3: a floor mop covering with two layers that form a slot, with the product information on a finger loop.

FIG. 3 shows a cleaning device (1") including a component (2") with associated product information (3). The component (2") has a surface (2"*a*) in which the product information (3) is intrinsic and/or integral to the material, with the product information (3) having been formed by means of an agent that is remotely located from said surface (2"*a*).

The component (2") is a finger loop. The finger loop is inscribed and furnished with product information (3).

The marking agent is a laser. The surface (2"*a*) is texturally altered in some areas, with the textural alterations forming characters, numbers, or symbols, which depict the product information.

The characters, numbers, or symbols depicting the product information protrude downward less than 0.1 mm from the surface (2"*a*). The surface (2"*a*) consists of a synthetic material, preferably polyester or polypropylene.

The cleaning device (1") is a floor mop covering. FIG. 3 concretely depicts a floor mop covering which is made from two layers.

The layers form a slot (4") into which a mop wing can be force-fitted.

Figure 4:
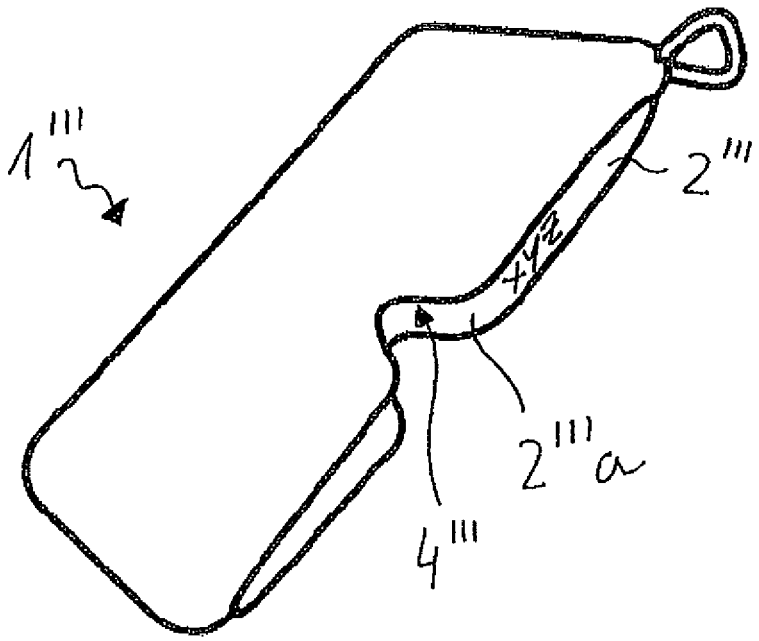
FIG. 4: a floor mop covering with two layers that form a slot, with the product information on the interior of the slot.

FIG. 4 shows a cleaning device (1''') including a component (2''') with associated product information (3). The component (2''') has a surface (2'''*a*) in which the product information (3) is intrinsic and/or integral to the material, with the product information (3) having been formed by means of an agent that is remotely located from said surface (2'''*a*).

The agent is a laser. The surface (2'''*a*) is texturally altered in some areas, with the textural alterations forming characters, numbers, or symbols which depict the product information (3).

The characters, numbers, or symbols depicting the product information protrude downward less than 0.1 mm from the surface (2'''*a*). The surface (2'''*a*) consists of a synthetic material, preferably polyester or polypropylene.

The cleaning device (1''') is a floor mop covering. FIG. 4 concretely represents a floor mop covering made from two layers.

The layers form a slot (4''') in which a mop wing may be force-fitted.

One of the layers is the component (2''') furnished with product information (3), with the product information in the interior of the slot (4''').

With regard to further advantageous design and development of the implementation of the invention, refer to the general portion of the description as well as to the accompanying patent claims.

What is claimed is:

1. A component for a cleaning device comprising:

a substantially planar first surface configured to be a cleaning surface of the component, and a substantially planar second surface formed opposite the first surface of the component, the second surface having product information that is intrinsic or integral to a material forming the second surface, the product information formed by a marking agent separate from the second surface, and the component includes one of: (a) two slots formed therein, the two slots disposed at opposite ends of the component, and (b) one slot formed therein, the one slot extending substantially an entire length of the component;

wherein the cleaning device is a floor mop covering, at least a portion of the second surface is texturally altered to include at least one of characters, numbers, and symbols depicting the product information, and the at least one of the characters, the numbers, and the symbols depicting the product information protrudes into the second surface less than about 0.1 mm.

2. The component for the cleaning device according to claim 1, wherein the marking agent is a laser and the product information contrasts with the second surface in one of lightness or darkness.

3. The component for the cleaning device according to claim 1, wherein the marking agent is an ink-jet dispenser dispensing an acid and the product information results from the acid interacting with the second surface.

4. The component for the cleaning device according to claim 1, wherein the second surface includes a synthetic material.

5. The component for the cleaning device according to claim 1, wherein the component includes a finger loop.

6. The component for the cleaning device according to claim 1, wherein the component is oblong.

7. The component for the cleaning device according to claim 1, wherein the component includes the one slot formed therein, the one slot extending substantially the entire length of the component and configured for force-fitting a mop-wing.

8. The component for the cleaning device according to claim 1, wherein the component includes the one slot formed therein, the one slot extending substantially the entire length of the component and the product information is located on an interior of the one slot.

9. The component for the cleaning device according to claim 1, wherein the component includes the one slot formed therein, the one slot extending substantially the entire length of the component and having a nonlinear edge.

10. The component for the cleaning device according to claim 1, wherein the component includes the two slots formed therein, each of the slots having an open end and a closed end.

11. The component for the cleaning device according to claim 1, wherein the marking agent is a laser and the product information has a color different from a color of the second surface.

12. The component for the cleaning device according to claim 1, wherein the marking agent is a laser and the product information includes a microstructure of foam.

13. The component for the cleaning device of according claim 4, wherein the synthetic material includes polyester or polypropylene.

14. The component for the cleaning device according to claim 5, wherein the product information is located on the finger loop.

15. The component for the cleaning device according to claim 1, wherein the floor mop covering is made from two layers that form the one slot extending substantially the entire length of the component.

16. The component for the cleaning device according to claim 15, wherein the product information is located on an interior of the one slot.

17. A component for a cleaning device comprising:

a substantially planar first surface configured to be a cleaning surface of the component; and a substantially planar second surface formed opposite the first surface of the component, the second surface having product information that is intrinsic or integral to a synthetic material forming the second surface, the product information including textural alterations of the second surface that are recessed less than 0.1 mm from the second surface, and the component including two slots formed therein, the two slots disposed at opposite ends of the component for insertion of a receptacle or mop wing;

wherein the cleaning device is a floor mop covering and the second surface is on one of the slots.

18. A component for a cleaning device comprising:

a substantially planar first surface configured to be a cleaning surface of the component; and a substantially planar second surface formed opposite the first surface of the component, the second surface having product information that is intrinsic or integral to a synthetic material forming the second surface, the product information formed by a marking agent separate from the second surface, and the component having an obling shape and including one slot formed therein, the one slot extending substantially an entire length of the component and having a nonlinear edge;

wherein the cleaning device is a floor mop covering, at least a portion of the second surface is texturally altered to include at least one of characters, numbers, and symbols depicting the product information, and the at least one of the characters, the numbers, and the symbols depicting the product information protrudes into the second surface less than about 0.1 mm.

19. The component for the cleaning device according to claim 5, wherein the finger loop is disposed on the second surface of the component.

20. The component for the cleaning device according to claim 5, wherein the product information is formed on the finger loop.

* * * * *